US007320238B1

(12) United States Patent
Voice

(10) Patent No.: US 7,320,238 B1
(45) Date of Patent: Jan. 22, 2008

(54) METHOD OF FORGING A TITANIUM ALLOY

(75) Inventor: Wayne E. Voice, Nottingham (GB)

(73) Assignee: Rolls-Royce PLC, London (GB)

( * ) Notice: Subject to any disclaimer, the term of this patent is extended or adjusted under 35 U.S.C. 154(b) by 62 days.

(21) Appl. No.: 11/176,382

(22) Filed: Jul. 8, 2005

(30) Foreign Application Priority Data

Jul. 28, 2004 (GB) ..... 0416764

(51) Int. Cl.
*B21B 45/00* (2006.01)
*B21B 45/02* (2006.01)

(52) U.S. Cl. ..... 72/46; 72/42

(58) Field of Classification Search ..... 72/41–42, 72/46–47

See application file for complete search history.

(56) References Cited

U.S. PATENT DOCUMENTS

| | | | | |
|---|---|---|---|---|
| 2,903,785 A * | 9/1959 | Hanink et al. | ..... | 29/889.71 |
| 4,055,975 A | 11/1977 | Serfozo et al. | | |
| 4,183,236 A | 1/1980 | Spiegelberg et al. | | |
| 4,318,792 A | 3/1982 | Snow | | |
| 4,595,473 A | 6/1986 | Kalamasz | | |
| 5,300,159 A * | 4/1994 | Petzoldt et al. | ..... | 148/525 |
| 5,743,121 A | 4/1998 | Miller | | |

FOREIGN PATENT DOCUMENTS

| | | | | |
|---|---|---|---|---|
| FR | 2 321 351 A | 3/1977 | | |
| FR | 2 961 705 A1 | 12/1993 | | |
| GB | 812819 | 4/1959 | | |
| GB | 814569 | 6/1959 | | |
| JP | A 62-133054 | 6/1987 | | |
| JP | A 62-286637 | 12/1987 | | |
| JP | 02104435 A * | 4/1990 | ..... | 72/42 |
| JP | A 02-104435 | 4/1990 | | |
| SU | 1 162 541 A | 6/1985 | | |

* cited by examiner

*Primary Examiner*—Derris H. Banks
*Assistant Examiner*—Teresa M Bonk
(74) *Attorney, Agent, or Firm*—Oliff & Berridge, PLC

(57) ABSTRACT

A method of forging a titanium alloy component comprises applying a protective coating onto the surface of the titanium alloy component. A glass lubricant coating is applied onto the protective coating and the titanium alloy component is forged at a high temperature. The glass lubricant coating comprises a borosilicate glass lubricant coating. The protective coating comprises an aluminide coating, a silicon modified aluminide coating, a platinum aluminide coating, an aluminium coating or a platinum coating. The titanium alloy component may be a compressor blade, or a compressor vane, of a high-pressure compressor of a gas turbine engine.

13 Claims, 1 Drawing Sheet

METHOD OF FORGING A TITANIUM ALLOY

Figure 1:
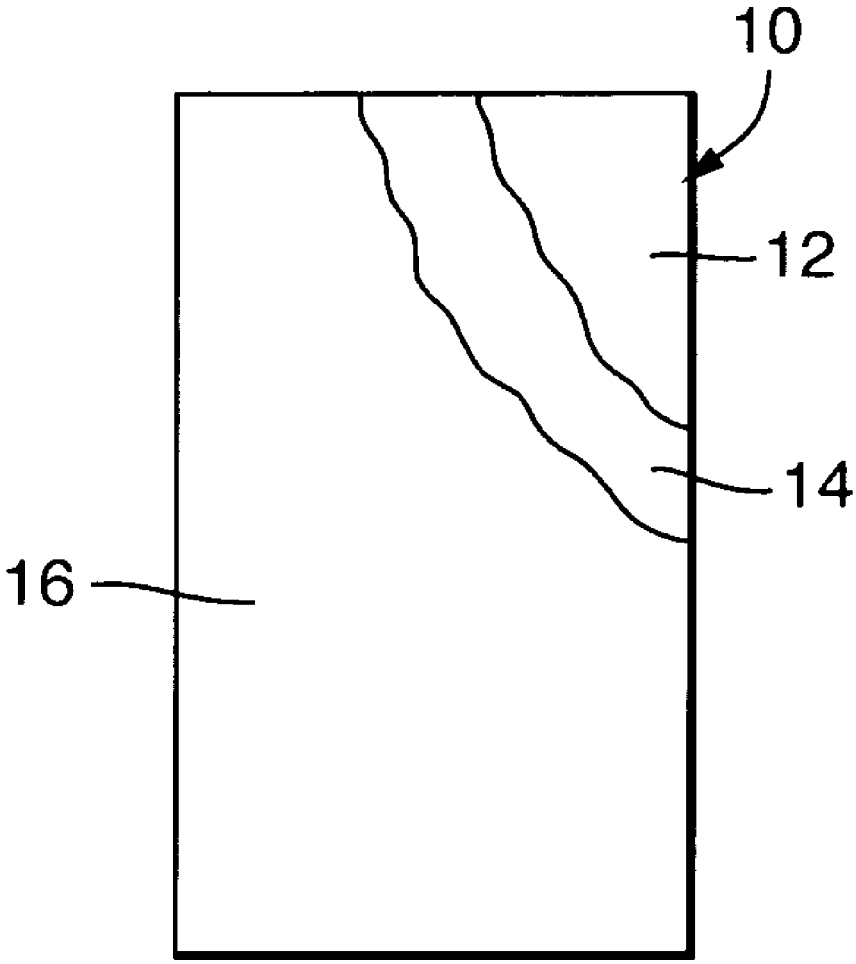

The present invention relates to a method of forging a titanium alloy and in particular to a method of forging titanium alloys with high levels of vanadium.

Conventionally alloys are coated with a high temperature borosilicate glass lubricant coating and are then forged at a high temperature.

It has been found that the high temperature borosilicate glass lubricant decomposes on the surface of titanium alloys with high levels of vanadium and chromium and this makes the surface quality of forged high vanadium and chromium titanium alloys unsatisfactory.

It has been found that liquid and vapour metal oxide, e.g. vanadium pentoxide, formed underneath the borosilicate glass lubricant produces decohesion or decomposition of the borosilicate glass which produces an unacceptable forging process and makes the surface quality of forged high vanadium and chromium titanium alloy unsatisfactory.

Accordingly the present invention seeks to provide a novel method of forging a titanium alloy, which reduces or overcomes the above-mentioned problem.

Accordingly the present invention provides a method of forging a titanium alloy comprising applying a protective coating onto the titanium alloy, applying a glass lubricant coating onto the protective coating and forging the titanium alloy at a high temperature.

Preferably the glass lubricant coating comprises a borosilicate glass lubricant coating.

Preferably applying the protective coating comprises applying an aluminide coating, a silicon modified aluminide coating, a platinum aluminide coating, an aluminum coating or a platinum coating.

Preferably applying the protective coating comprises pack aluminizing, vapour phase aluminizing, slurry aluminizing, spraying, heat-treating or plating.

Preferably the titanium alloy consists of vanadium and chromium.

Preferably the titanium alloy consists of 20 wt % to 40 wt % vanadium and 10 to 20 wt % chromium.

Preferably the titanium alloy consists of 20 wt % to 30 wt % vanadium, 13 wt % to 17 wt % chromium, 1.0 wt % to 3.0 wt % aluminum, 0.1 wt % to 0.4 wt % carbon and up to 0.2 wt % oxygen and balance titanium and incidental impurities.

Preferably the titanium alloy consists of 25 wt % vanadium, 15 wt % chromium, 2 wt % aluminum, up to 0.15 wt % oxygen, 0.1 wt % to 0.3 wt % carbon and the balance titanium plus incidental impurities.

Preferably the titanium alloy consists of 35 wt % vanadium and 15 wt % chromium.

Preferably the titanium alloy is forged into a compressor blade or a compressor vane.

The present invention will be more fully described by way of example with reference to the accompanying drawings in which:—

FIG. 1 shows a titanium alloy component with a protective coating to be used in a method of forging according to the present invention.

A method of forging a titanium alloy component 10 comprises applying a protective coating 14 onto the surface 12 of the titanium alloy component 10. A glass lubricant coating 16 is applied onto the protective coating 14 and then the titanium alloy component 10 is forged at a high temperature, for example about 1050° C.

The titanium alloy component 10 comprises a titanium alloy consisting of vanadium and chromium and other elements, for example a titanium alloy consisting of 20 wt % to 40 wt % vanadium and 10 to 20 wt % chromium. The titanium alloy preferably consisting of 20 wt % to 30 wt % vanadium, 13 wt % to 17 wt % chromium, 1.0 wt % to 3.0 wt % aluminum, 0.1 wt % to 0.4 wt % carbon and up to 0.2 wt % oxygen and balance titanium and incidental impurities. A particular titanium alloy consists of 25 wt % vanadium, 15 wt % chromium, 2 wt % aluminum, up to 0.15 wt % oxygen, 0.1 wt % to 0.3 wt % carbon and the balance titanium plus incidental impurities. Another particular titanium alloy consists of 35 wt % vanadium and 15 wt % chromium.

A suitable glass lubricant coating comprises a borosilicate glass lubricant coating.

The preferred protective coating comprises an aluminide coating, a silicon modified aluminide coating, a platinum aluminide coating, an aluminum coating or a platinum coating. The protective coating is applied by pack aluminizing, vapour phase aluminizing, slurry aluminizing, spraying, heat-treating or plating.

One particular protective coating is a silicon-modified aluminide produced by slurry aluminizing. Such protective coatings are available as IPAL IP1041 from Indestructible Paints Ltd of 23-25 Pentos Drive, Sparkhill, Birmingham, B11 3TA or Sermaloy J (RTM) from Sermatech (UK) Ltd of High Holbom Road, Codnor Gate Business Park, Ripley, DE5 3NW.

Another particular protective coating is an aluminum water base inorganic acid coating is sprayed onto the titanium alloy component and then cured at a temperature of 540° C. to 560° C. Such protective coatings are available as IPCOTE IP9183, or IPCOTE IP9183R1, from Indestructible Paints Ltd of 23-25 Pentos Drive, Sparkhill, Birmingham, B11 3TA or Sermetal W from Sermatech (UK) Ltd of High Holbom Road, Codnor Gate Business Park, Ripley, DE5 3NW.

The protective coating of an aluminide coating is produced by aluminizing and the platinum aluminide coating is produced by platinum aluminizing. Such protective coatings are available as CN32/1 or CN32/2 and as CN22 or CN22LT from Chromalloy (UK) Ltd of Bramble Way, Clover Nook Industrial Estate, Somercotes, Alfreton, Derbsyshire, DE55 4RH.

In use the protective coating 12 prevents the formation of metal oxides, e.g. vanadium pentoxide, under the glass lubricant coating 14 and hence the glass lubricant coating 14 is not decomposed during the forging process and thus the forging process produces an acceptable surface quality of the forged titanium alloy component 10.

Other suitable protective coatings may be used.

The titanium alloy components may for example be compressor blades, or compressor vanes, of a high-pressure compressor of a gas turbine engine.

The present invention is also applicable to titanium alloys consisting of about 15 wt % vanadium.

I claim:

1. A method of forging a titanium alloy including vanadium, the method comprising:

applying a protective coating onto the titanium alloy; and applying a glass lubricant coating onto the protective coating and forging the titanium alloy at a high temperature, the protective coating being selected from a group consisting of an aluminide coating, a silicon modified aluminide coating, a platinum aluminide coating, an aluminum coating and a platinum coating.

2. A method of forging as claimed in claim 1 wherein the glass lubricant coating comprises a borosilicate glass lubricant coating.

3. A method of forging as claimed in claim 1 further comprising applying the protective coating by a method selected from a group consisting of pack aluminizing, vapor phase aluminizing, slurry aluminizing, spraying, heat treating and plating.

4. A method of forging as claimed in claim 1 wherein the titanium alloy includes vanadium and chromium.

5. A method of forging as claimed in claim 4 wherein the titanium alloy includes 20 wt % to 40 wt % vanadium and 10 to 20 wt % chromium.

6. A method of forging as claimed in claim 5 wherein the titanium alloy consists of 20 wt % to 30 wt % vanadium, 13 wt % to 17 wt % chromium, 1.0 wt % to 3.0 wt % aluminum, 0.1 wt % to 0.4 wt % carbon and up to 0.2 wt % oxygen and balance titanium and incidental impurities.

7. A method of forging as claimed in claim 6 wherein the titanium alloy consists of 25 wt % vanadium, 15 wt % chromium, 2 wt % aluminum, up to 0.15 wt % oxygen, 0.1 wt % to 0.3 wt % carbon and the balance titanium plus incidental impurities.

8. A method of forging as claimed in claim 5 wherein the titanium alloy includes 35 wt % vanadium and 15 wt % chromium.

9. A method of forging as claimed in claim 1 comprising forging the titanium alloy into a compressor blade.

10. A method of forging as claimed in claim 1 comprising forging the titanium alloy into a compressor vane.

11. A method of forging a titanium alloy including vanadium, the method comprising:

applying a protective coating onto the titanium alloy; and applying a glass lubricant coating onto the protective coating and forging the titanium alloy at a high temperature, the protective coating being selected from a group consisting of an aluminide coating, a silicon modified aluminide coating, a platinum aluminide coating and a platinum coating.

12. A method of forging a titanium alloy including vanadium, the method comprising:

applying a protective coating onto the titanium alloy;

applying a glass lubricant coating onto the protective coating and forging the titanium alloy at a high temperature, the protective coating being selected from a group consisting of an aluminide coating, a silicon modified aluminide coating, a platinum aluminide coating, an aluminum coating and a platinum coating; and applying the protective coating by a method selected from the group comprising pack aluminizing, vapor phase aluminizing, slurry aluminizing, spraying, heat treating and plating.

13. A method of forging as claimed in claim 1 wherein the titanium alloy includes 15 wt % to 40 wt % vanadium.

* * * * *